US005613568A

United States Patent [19]

Sterner et al.

[11] Patent Number: 5,613,568

[45] Date of Patent: Mar. 25, 1997

[54] ROCK DRILLING MACHINE

[75] Inventors: Lars Sterner, Kiruna; Lennart Nilsson, Videplan 2 F, S-981 43 Kiruna, both of Sweden

[73] Assignee: Lennart Nilsson, Kiruna, Sweden

[21] Appl. No.: 549,794

[22] PCT Filed: May 4, 1994

[86] PCT No.: PCT/SE94/00405

§ 371 Date: Nov. 1, 1995

§ 102(e) Date: Nov. 1, 1995

[87] PCT Pub. No.: WO94/27022

PCT Pub. Date: Nov. 24, 1994

[30] Foreign Application Priority Data

May 6, 1993 [SE] Sweden ..... 9301555

[51] Int. Cl.[6] ..... E21B 3/02

[52] U.S. Cl. ..... 175/94; 175/99

[58] Field of Search ..... 175/51, 73, 97, 175/98, 99, 94

[56] References Cited

U.S. PATENT DOCUMENTS 4,332,420 6/1982 Coski ..... 175/94 X
4,474,253 10/1984 Kleuters ..... 175/99 X

FOREIGN PATENT DOCUMENTS

2920049A1 2/1981 Germany .
1105701 3/1968 United Kingdom .
PCT/DE88/00744 6/1989 WIPO .

*Primary Examiner*—William P. Neuder
*Attorney, Agent, or Firm*—Rolf Fasth

[57] ABSTRACT

A rock drilling machine of the self-feeding, integrated type which is designed to operate in situ in a drill hole. The rock drilling machine comprises a drive unit (1), an anchoring unit (2), and a feeding unit (3) which is active between the anchoring unit (2) and the drive unit (1). The drive unit (1) comprises a hydraulic power assembly (5, 8) at the rear end of the unit, a drill bit (21) which is rotatable at the front end of the unit, a guide (10) with a longitudinal cavity (23), which guide extends between the hydraulic power assembly and the drill head and connects these non-rotatably to each other, a rotatable drive shaft (22) which extends from the hydraulic power assembly, through the said cavity in the guide, for rotation of the drill bit, and first securing devices (17) in order to be able to anchor the drive unit releasably in the drill hole. The anchoring unit (2) comprises at least one control element (30') around the said guide, and second securing devices (31, 31') in order to anchor the control element releasably by means of engagement against the drill hole wall, and the feeding unit (3) comprises at least three individually manoeuvrable hydraulic cylinders (60–62) between the anchoring unit and the drive unit for feeding the drill bit forwards in the desired direction, when the said first securing devices are inactive, and when the said second securing devices actively anchor the control element in the drill hole.

9 Claims, 6 Drawing Sheets

ROCK DRILLING MACHINE

TECHNICAL FIELD

The invention relates to a rock drilling machine of the self-feeding, integrated type which is designed to operate in situ in a drill hole.

BACKGROUND OF THE INVENTION

Deviations from the planned hole direction constitute a major problem when drilling long holes in the bedrock. This is especially true when the holes are directed up above the horizontal plane. The methods which are currently employed all presuppose the use of drill hole tubing, which makes both monitoring and directional adjustment impossible. In practice, the drilling is carried out completely blind, and this also shows in the results. Attempts have been made to develop techniques which make drill hole tubing redundant. However, techniques proposed hitherto have had such shortcomings that they have not been used in practice. They are generally based on internal fixtures, which considerably limits the available space in the drill hole.

DISCLOSURE OF THE INVENTION

The object of the invention is to provide a rock drilling machine of the abovementioned type, which can solve the abovementioned problem. A particular aim of the invention is to utilize the available drill hole area optimally. A further aim is to propose a simple, practical solution to the guidance problem, in other words to permit precision drilling in the bedrock, so that the result corresponds, with a high degree of precision, to the predetermined hole direction. However, the invention is not limited to producing straight holes alone, and instead the term "predetermined hole direction" entails the more general object of producing drill holes following a trajectory which is determined in advance and which may be curved.

These and other aims can be achieved with a rock drilling machine which is characterized by what is stated in the patent claims which follow. Further characteristics and aspects of the invention will emerge from the following description of a preferred embodiment.

BRIEF DESCRIPTION OF DRAWINGS

In the following description of a preferred embodiment, reference will be made to the accompanying drawings, in which.

DESCRIPTION OF PREFERRED EMBODIMENT

Figure 1:
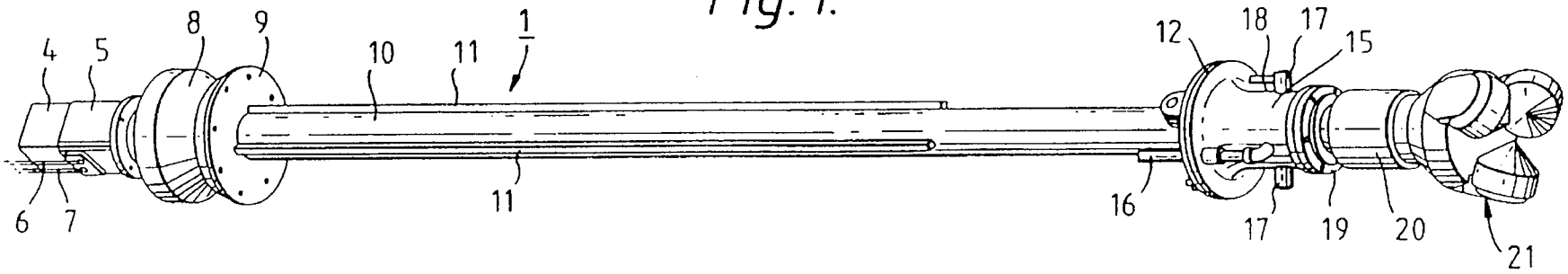
FIG. 1 is a perspective view of a unit which is referred to hereinbelow as a drive unit.
Figure 2:
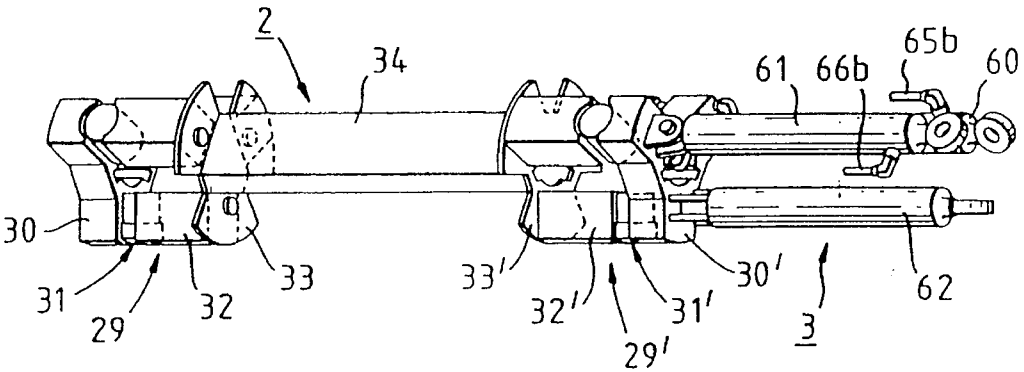
FIG. 2 is a perspective view of a unit referred to as an anchoring unit, and of a unit referred to as a feeding unit.

The drilling machine 1 consists functionally of three main parts, namely a unit which is here referred to as the drive unit 1, a unit which is here referred to as the anchoring unit 2, and a unit 3, here referred to as the feeding unit, which is arranged between the anchoring unit 2 and the drive unit 1.

The drive unit 1 comprises, from the rear and towards the front, the following components: a direction indicator 4, a hydraulic motor 5 with input and output lines 6, 7 for hydraulic medium, a transmission box 8, a rear mounting plate 9, a tubular guide 10 which has, along the greater part of its length, three longitudinal splines 11 which are directed radially outwards, a front mounting plate 12 which has, on the rear side, three pairs of attachments 14 for hydraulic cylinders which are included in the feeding unit 3, a drill neck 15, a water line 16 for flush water, first securing devices 17 on the drill neck 15, and a hydraulic line 18 to the first securing devices 17, a drill collar 19, a drill shank 20 and a drill bit 21 at the very front, and also, between the transmission box 8 and the drill bit 21, a drive shaft 22 which extends through an internal cavity 23 in the guide 10. The drill shank 20 can be replaced, if appropriate, by a collar which is welded directly onto the drill bit 21. The latter is then joined by screw connection to its counterpart in front of the drill neck 15, as will be described with reference to FIG. 11.

The anchoring unit 2 consists of rear and front control and anchoring assemblies 29, 29', which assemblies are joined to one another via a longitudinal and essentially triangular box girder 34 which surrounds the guide 10. The rear and front control and anchoring assemblies 29, 29' are identical to each other, but of mirror-inverted configuration. They each comprise, respectively, a rear and a front control block 30, 30', a rear and a front second securing device 31, 31', and a rear and a front mounting disc 33, 33'.

Figure 5:
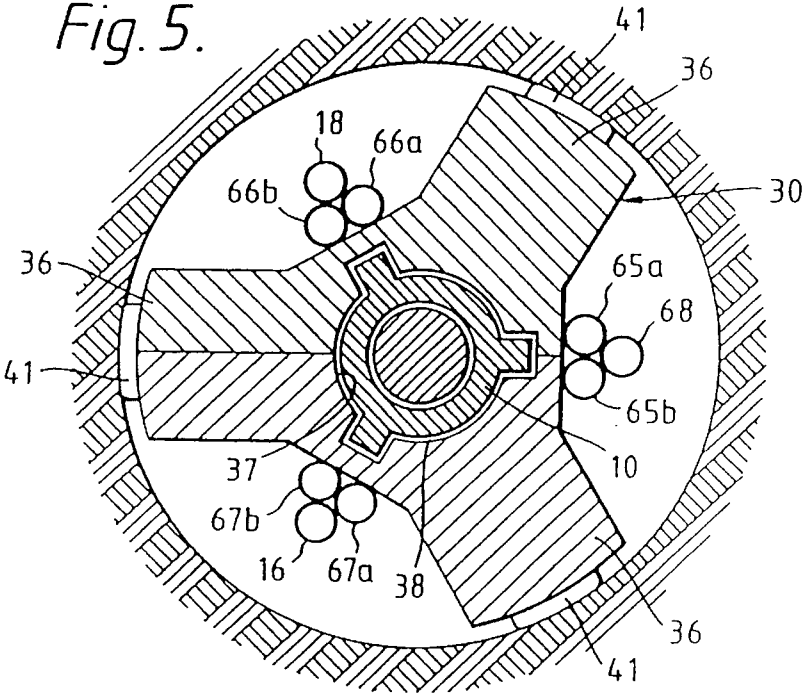
FIG. 5 shows, on the same scale, a control block in a sectional view along V—V in FIG. 3.
Figure 4:
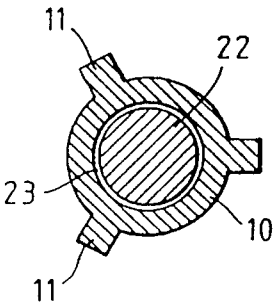
FIG. 4 shows, on a larger scale, a guide and drive shaft in a sectional view along IV—IV in FIG. 3.

The two control blocks 30, 30', like the control block 30 in FIG. 5, have, in sectional view, the essential shape of an equilateral triangle, with substantial radial protrusions 36 at the corners of the triangle. A hole 37 extends through the centre of the control block, which hole 37 is greater than the external dimensions of the guide 10, but otherwise has a shape corresponding to that of the guide 10. Thus, there is a gap 38 between the wall of the hole 37 and the guide 10, this gap 38 extending all around the guide 10, including around the splines or protrusions 11 of the guide. On account of this gap 38, the guide 10 can be set at different angles—within a certain limited range of variation—relative to a centre line through the anchoring unit 2. The control blocks 30 and 30' have an external diameter which is smaller than the diameter in the intended drill hole. So that they can be used for drill holes of different diameters, the control blocks 30, 31 can be divided and are thus exchangeable.

A characteristic feature of roller bits is that the wear in the diametral direction is negligible, for which reason the hole diameter can be regarded as constant along the entire length of the drill hole. This circumstance is made use of in the invention for centring the anchoring unit 2 in the drill hole with the aid of the two control and anchoring assemblies 29, 29', more specifically with the aid of the rear and front second securing devices 31, 31'.

Figure 6:
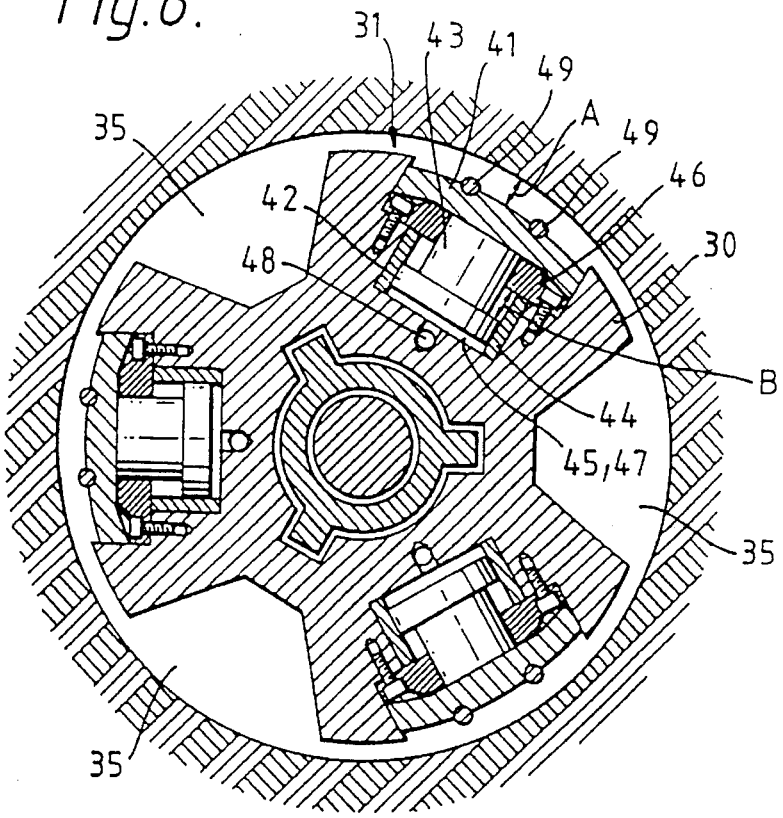
FIG. 6 shows, on the same scale, the control block with securing devices in an inactive position, in a view along VI—VI in FIG. 3.
Figure 7:
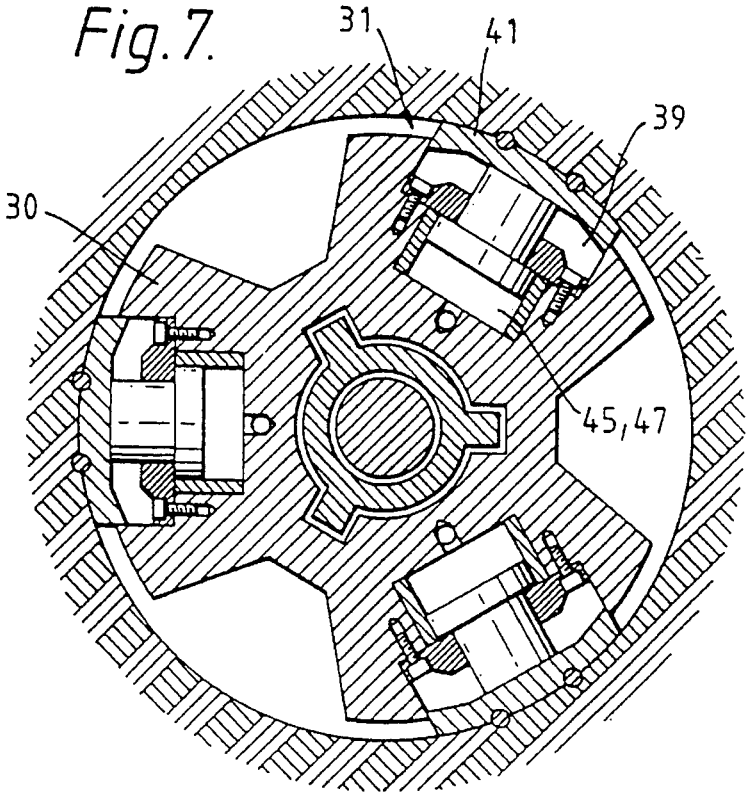
FIG. 7 shows the same view as FIG. 6, but with the securing devices in an active position.

Each of the rear second securing devices 31, FIG. 6 and FIG. 7 (the front second securing devices 31' are formed in the same way as the rear second securing devices 31) comprises an anchoring heel 41, which can be moved between an inactive, retracted position, FIG. 6, and an active anchoring position, FIG. 7, with the aid of a hydraulic piston 42 which is connected, via a short, thick piston rod 43, to the securing heel 41 and is movable in a hydraulic cylinder 44. The hydraulic cylinder 44 consists of a sleeve or bushing, braced in a recess 45 in the control block 30 between the bottom of the recess and a clamping ring 46 which is screwed tight in the control block 30. Hydraulic oil is supplied to and withdrawn from a hydraulic chamber 47 via a channel 48 in the control block 30. A number of hard metal pins 49 in the form of round balls are fixed in the surface of the anchoring heel 41 in such a way that they protrude from the surface of the anchoring heel.

At the same time as the clamping ring 46 clamps the bushing 44 securely in the recess 45, it also acts as a guide for the piston rod 43 and as a limit stop for the outward movement of the piston 42. The distance B between the piston 42 and the clamping ring 46, when the piston 42 is drawn back to the maximum extent into the hydraulic chamber 47 and the anchoring heel 41 is drawn back to the maximum extent, to the inactive position, in a groove 39 in the control block 30, is chosen such that it corresponds to the width of the gap A between the hole wall and the anchoring heel 41. By virtue of the fact that A=B, the control block 30 is centred in the drill hole when each of the three pistons 42 is pressed out, in the respective hydraulic chamber 47, to bear against the clamping ring 46. At the same time the hard metal pins 49 penetrate into the rock and strengthen the anchoring. The return movement is achieved by means of relieving the pressure in the hydraulic chamber 47 via the channel 48, so that the whole anchoring unit 2 can drop and come to bear on the lower drill hole wall (it being understood that the drill hole is horizontal or at least to some extent inclined in relation to the vertical plane), after which the unit can be dragged forwards (or backwards) in the drill hole.

Figure 8:
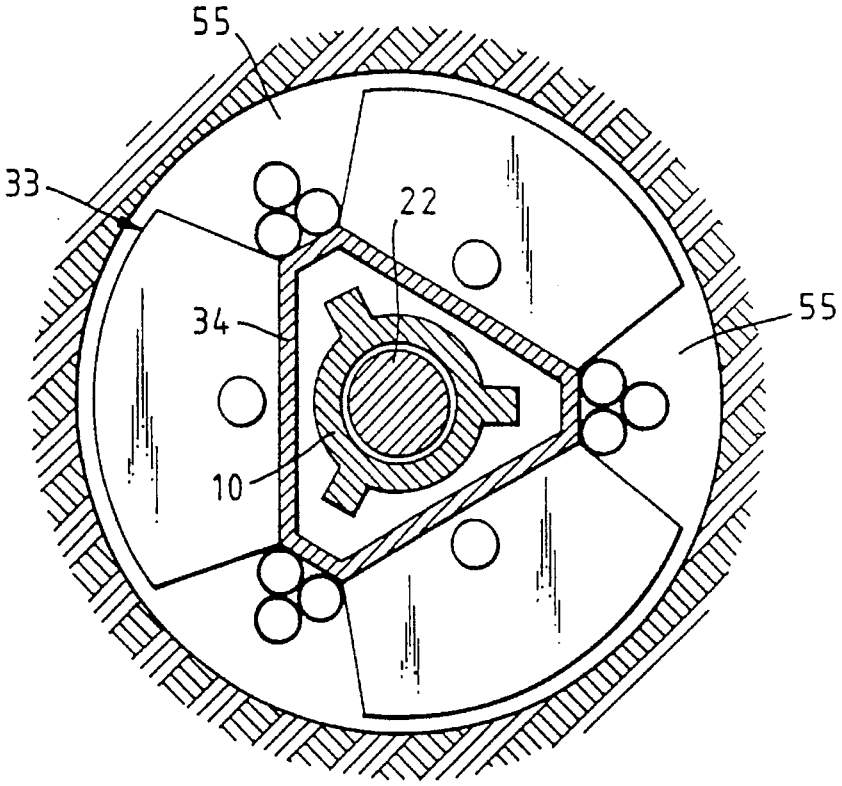
FIG. 8 shows, on the same scale, a view along VIII—VIII in FIG. 3.

The control blocks 30, 30' are terminated, respectively, by the rear and front mounting discs 33, 33', FIG. 8, which are screwed firmly to the respective control block. The mounting discs have recesses 50, 55, in line with the free spaces 35 between the protrusions 36 of the control blocks, for the passage of the hydraulic lines and the flush water line. The box girder 34 is welded to the two mounting discs 33, 33' and thus connects the rear and front control and anchoring assemblies 29, 29' in order to form an integrated anchoring unit 2.

The water line 16 can be replaced, if appropriate, by an inlet in front of the rear mounting plate 33. The water can in this case be conveyed into the gap 23 between the drive shaft 22 and the guide 10.

Figure 9:
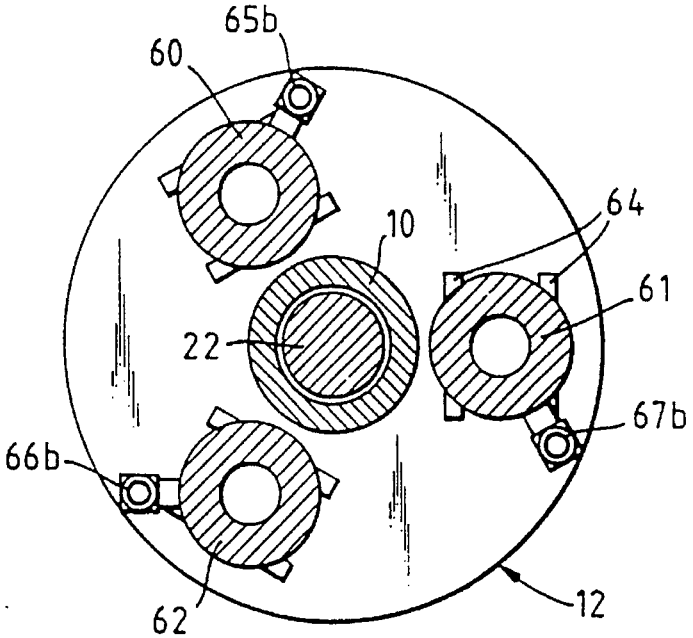
FIG. 9 shows, on the same scale, a feeding unit in a view along IX—IX in FIG. 3.

The feeding unit 3 consists of three hydraulic cylinders 60, 61, 62 which are arranged in star formation, as can be seen from FIG. 9, parallel to, or at a slight angle to, the centre line 25 of the drilling machine. At the rear ends they are mounted in an articulated manner on the front control block 30 via securing lugs 63, and at the front end they are secured in an articulated manner on the front mounting plate 12 via securing lugs 64. Hydraulic hoses or hydraulic pipes 65*a*, 65*b*, 66*a*, 66*b*, 67*a*, 67*b* lead to and from the three hydraulic cylinders 60–62.

The three hydraulic cylinders 60–62 can be manoeuvred individually and independently of one another by adjusting the pressure medium in the connection lines 65*a*–67*a*, that is to say by individual adjustment of the propulsion force of the hydraulic cylinders. This manoeuvring is carried out as a function of the alignment of the drive unit 1 relative to the anchoring unit 2, which is well centred in the drill hole. A measure of the direction is obtained from the direction indicator 4.

Different auxiliary means can be used as direction indicator 4, it being possible for these means to operate in accordance with completely different principles. For example, the direction indicator 4 can consist of a laser which transmits a laser beam rearwards, in line with, or parallel to, the centre line 25 of the drive unit 1. In this case a sensor is arranged in the mouth of the drill hole, which sensor notes the direction of the laser beam and, consequently, of the drive unit 1 in relation to a certain given direction. Depending on the measurement result, possible corrections can then be made by means of individual manoeuvring of the three hydraulic cylinders 60–62.

The direction indicator 4 can alternatively consist of a gyro compass which gives a measurement of the direction of the drive unit 1 in relation to a given direction. This measurement value, which can be obtained as electrical parameters, can be transmitted to the mouth of the drill hole and there read off for manual or automatic adjustment of the manoeuvring cylinders.

In addition to the said hydraulic lines 65*a*–67*b* to the manoeuvring cylinders 60–62, a hydraulic line (not shown) of the hydraulic channel 48 leads to the rear second securing devices 31, and a line 68 leads to the front second securing devices 31'. The said lines arranged in the spaces 35 have not been shown in FIG. 6 and FIG. 7.

Figure 3:
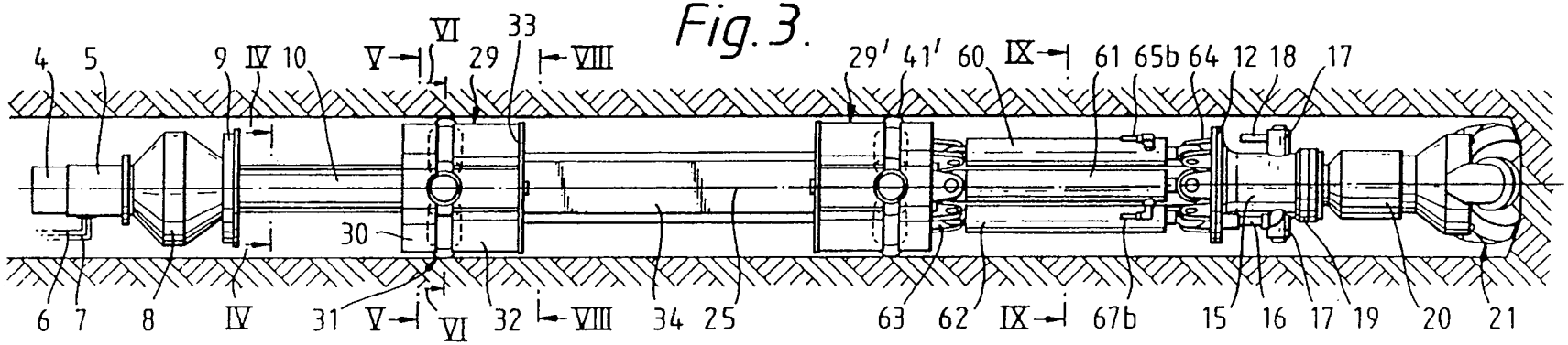
FIG. 3 is a partially schematic side view of the integrated drilling machine during drilling in a drill hole.

The machine which has been described functions in the following way. The starting position is assumed to be that which is shown in FIG. 3. The hydraulic motor 5 drives the shaft 22 via the transmission 8 and thereby rotates the drill bit 21. The anchoring unit 2 is centred in the drill hole, in the manner which has been described above, with the aid of the rear and front second securing devices 31, 31', which, at an early stage, anchor the entire drilling machine in the drill hole under the effect of the hydraulic pressure which acts on the anchoring heels 41, 41'.

The direction of the drive unit 1 is detected with the aid of the direction indicator 4 and the sensor members which are arranged outside the drill hole, and, as has been described above, the three hydraulic cylinders 60, 61, 62 are manoeuvred individually, as a function of the direction in question, so that the direction of the drive unit 1 in relation to the centre line of the anchoring unit 2 is modified, at the same time as the same hydraulic cylinders feed the drive unit 1 forwards with the guide 10 sliding in the control blocks 30, 30'. The directional adjustment is possible by virtue of the gap 38 between the guide 10 and the periphery of the cavity 37 in the two control blocks 30, 30'. The guide 10 and, consequently, the entire drive unit 1 can in other words be tilted at a slight angle relative to the anchoring unit on account of the said gap 38 in the two control blocks 30, 30'.

During drilling, the drive unit 1 is thus fed forwards relative to the anchoring unit 2, which is stationary in the drill hole, by the three hydraulic cylinders 60–62, with the guide 10 sliding in the cavity 37 in the control blocks 30, 30'.

When, during drilling into the rock, the drive unit 1 with the drill bit 21 has been advanced as far as the hydraulic cylinders 60–62 permit, the supply of hydraulic fluid to the hydraulic cylinders 60–62 via the connection lines 65*a*–67*a* is interrupted. Pressure medium is thereafter supplied to the first securing devices 17 which are arranged on the drive unit, more specifically on the drill neck 15 according to the embodiment, whereupon these first securing devices 17 are pressed out radially to engage against the wall of the drill hole. The second securing devices 31, 31' are then relieved of pressure, as regards the hydraulic pressure in their hydraulic lines.

In the next stage, hydraulic medium is supplied under pressure to the hydraulic cylinders 60–62 via the lines 65*b*–67*b*, so that the hydraulic pistons execute a return stroke, as a result of which the anchoring unit 2 is dragged forwards a distance corresponding to the stroke of the hydraulic cylinders 60–62, during which the pressure-relieved anchoring heels 41, 41' can drag against the drill hole wall, as has been described above. Thereafter, the rear and front second securing devices 31, 31' are once again pressurized by means of the supply of hydraulic fluid under pressure, so that the anchoring unit 2 is once more firmly anchored in the drill hole, at the same time as the first securing devices 17 on the drive unit 1 are relieved of pressure and are released from their engagement against the drill hole wall. A work cycle is thus completed, and the operation can continue as has been described above.

The front securing devices 17 function as a safety means by virtue of the fact that they are spring-loaded. They are normally activated when the anchoring unit 2 is being dragged forwards again. During drilling they are drawn in by means of hydraulic pressure on the negative side. The function of the front securing devices 17 is therefore to bear the inherent weight of the drilling machine and to withstand the friction which occurs when the anchoring unit 2 is being dragged forwards again. However, in the event of hosing breaking, the contact pressure against the hole wall must not be so great/powerful that the drilling machine cannot be pulled out with the aid of attached wires or cables (not shown).

Figure 10:
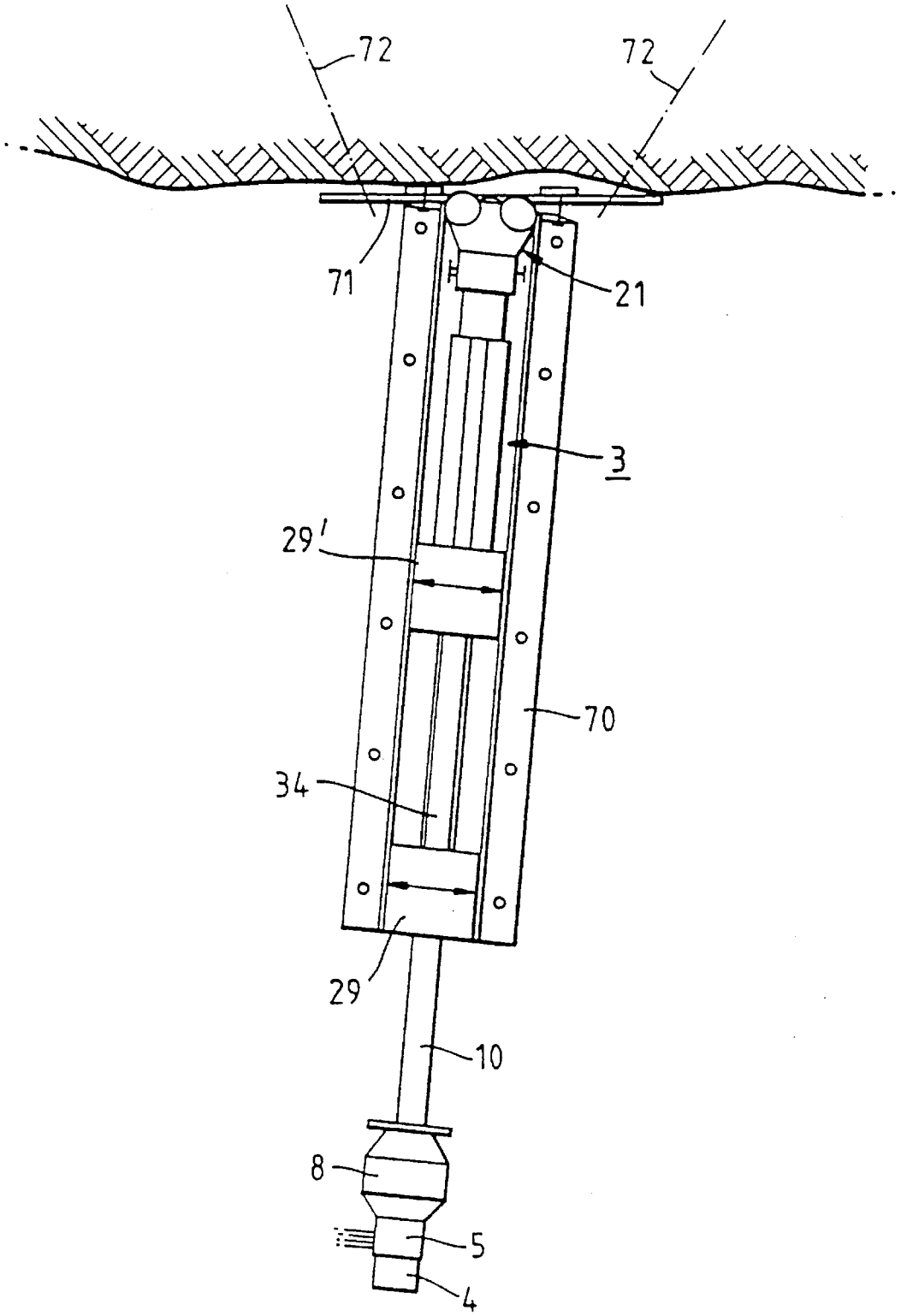
FIG. 10 is a side view of a so-called starter tube in the working position.

When starting a drilling operation, use is made of the starter tube 70 which is shown in FIG. 10. The support used is the same type of articulated frame steered vehicle as for machanized scaling, with all pumps and electric motors on board. The drilling machine, the main parts of which have been indicated in FIG. 10, is secured for transport in the starter tube 70, which is initially anchored in the beak-like front part (not shown) of the support (not shown). At the drill site, a collar 71 is bolted firmly in the rock with the aid of bolts 72. The alignment of the starter tube 70 is finely adjusted by means of inclination relative to the collar 71, after which the drilling can begin.

In the embodiment described, the hydraulic cylinders which are responsible for the feeding and direction of the drive unit are three in number and are arranged symmetrically in front of the anchoring unit. This represents an advantageous positioning and arrangement of these cylinders. However, other positionings and arrangements can also be conceived in principle. For example, it is possible to imagine having one or more hydraulic cylinders responsible for the feeding of the drive unit, and having some hydraulic cylinders responsible for the directional adjustment. It is in principle also conceivable to place some or all of the feeding and direction-adjusting hydraulic cylinders behind the anchoring unit, instead of in front of the latter, for example between the anchoring unit and the rear mounting plate.

Figure 11:
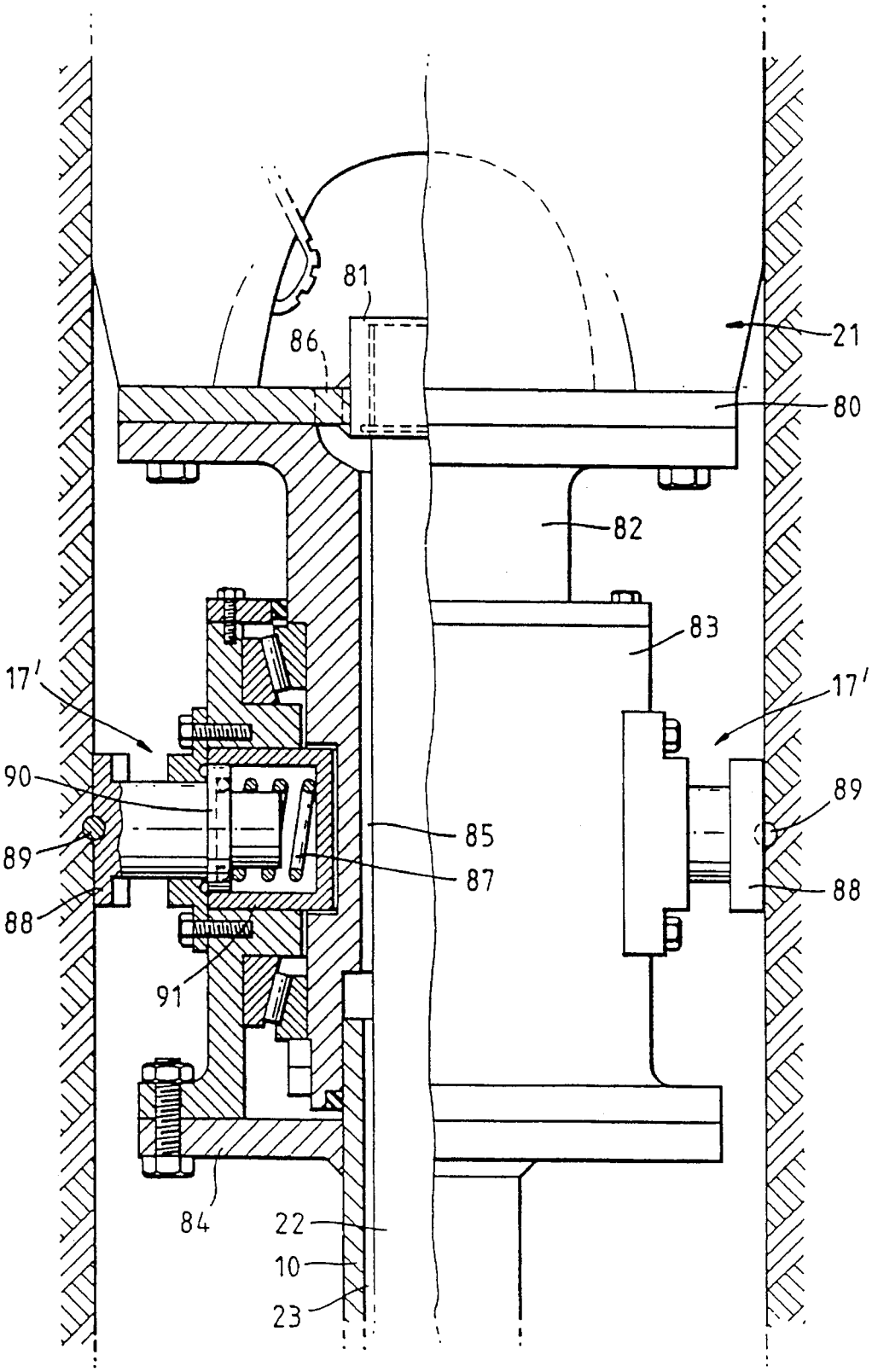
FIG. 11 illustrates an alternative embodiment of the flushing system and of the attachment of the drill bit.

It has also been mentioned above that the flushing system and the drill bit can be arranged in another way. This is illustrated in FIG. 11, where the drill bit 21 is shown mounted on a disc 80. The disc 80 is connected, via a sleeve 81 with splines, to the drive shaft 22 and, via screws, to a collar 82. This thus forms, together with the disc 80, the sleeve 81 and the shaft 22, a rotating, integrated unit, the collar 82 being mounted in a drill neck 83 which is screwed firmly to an end plate 84, which in turn is welded on the guide 10. Water is introduced into the gap 23 between the drive shaft 22 and the guide 10 at a point behind the anchoring unit 2 and is conveyed through this gap 23 into a gap 85 between the shaft 22 and the collar 82, and onward through a number of openings 86, so that the drill bit 21 is flushed with water.

Also arranged in the collar 82 are at least two front securing devices 17' which are spring-loaded in order to give necessary grip during recovery, i.e. when the anchoring unit 2 is to be dragged forwards a distance, and in order to function as a safety means. Such a spring has been designated by 87. For releasing the securing plates 88 of the securing devices from the rock wall, which securing plates are provided with hard metal spheres 89 which penetrate into the rock wall, a hydraulic piston 90 is arranged in a hydraulic cylinder 91, which is recessed in a circular groove in the collar 82, as a result of which the latter is at the same time anchored in the axial direction in the drill neck 83.

Other modifications and refinements are also conceivable within the scope of the invention, which is therefore not limited to the above description of possible embodiments.

We claim:

1. Rock drilling machine of the self-feeding, integrated type which is designed to operate in situ in a drill hole, characterized in that it comprises a drive unit (1), an anchoring unit (2), and a feeding unit (3) active between the anchoring unit (2) and the drive unit (1), in that the drive unit (1) comprises a hydraulic power assembly (5, 8) at the rear end of the drive unit, a drill bit (21) which is rotatable at the front end of the drive unit, a guide (10) with a longitudinal cavity (23), which guide extends between the hydraulic power assembly and the drill head and connects these non-rotatably to each other, a rotatable drive shaft (22) which extends from the hydraulic power assembly, through the said cavity in the guide, for rotation of the drill bit, and first securing devices (17) in order to be able to anchor the drive unit releasably in the drill hole, in that the anchoring unit (2) comprises at least one control element (30') around the said guide, and second securing devices (31, 31') in order to anchor the control element releasably by engagement against the drill hole wall, and in that the feeding unit (3) comprises at least three individually manoeuvrable hydraulic cylinders (60–62) between the anchoring unit and the drive unit for feeding the drill bit forwards in the desired direction, when the said first securing devices are inactive and when the said second securing devices actively anchor the control element in the drill hole.

2. Rock drilling machine according to claim 1, characterized in that the drive unit (1) can be directionally adjusted relative to the anchoring unit by means of individual manoeuvring of the said individually manoeuvrable hydraulic cylinders.

3. Rock drilling machine according to claim 2, characterized in that the individually manoeuvrable hydraulic cylinders are designed to feed the drive unit forwards with an individually adjusted feeding force.

4. Rock drilling machine according to claim 3, characterized in that the individually manoeuvrable hydraulic cylinders are arranged around the guide and are directed parallel to the centre line thereof.

5. Rock drilling machine according to claim 3, characterized in that the individually manoeuvrable hydraulic cylinders are arranged around the guide and are directed at an angle to the centre line of the guide.

6. Rock drilling machine according to claim 3, characterized in that at least one hydraulic cylinder is arranged between the anchoring unit and the drive unit, parallel or essentially parallel to the centre line of the guide in order to feed the drive unit forwards, and in that a plurality of manoeuvring cylinders are provided in order to directionally adjust the drive unit relative to the anchoring unit, essentially without feeding the drive unit forwards.

7. Rock drilling machine according to claim 1, characterized by a space (38) between the inside of the control element and the outside of the guide, which space (38) permits inclination of the guide and, consequently, of the entire drive unit relative to the control element, and, consequently, relative to the entire anchoring unit and relative to the direction of the drill hole within the area of the anchoring unit.

8. Rock drilling machine according to claim 1, characterized in that at least one of the individually manoeuvrable hydraulic cylinders is arranged in front of the anchoring unit.

9. Rock drilling machine according to claim 1, characterized in that the individually manoeuvrable hydraulic cylinders are three in number and are directed parallel to, or at a slight angle to, the centre line of the guide, and in that all three are arranged in front of the anchoring unit.

* * * * *